US006932144B2

(12) United States Patent
Shirley et al.

(10) Patent No.: US 6,932,144 B2
(45) Date of Patent: Aug. 23, 2005

(54) METHOD FOR CASTING OBJECTS WITH AN IMPROVED RISER ARRANGEMENT

(75) Inventors: Mark S. Shirley, Geneva, IL (US); Michael A. Bland, Pickerington, OH (US)

(73) Assignee: Amsted Industries Inc., Chicago, IL (US)

( * ) Notice: Subject to any disclaimer, the term of this patent is extended or adjusted under 35 U.S.C. 154(b) by 22 days.

(21) Appl. No.: 10/413,619

(22) Filed: Apr. 14, 2003

(65) Prior Publication Data

US 2004/0200595 A1 Oct. 14, 2004

(51) Int. Cl.[7] ..... B22C 9/08
(52) U.S. Cl. ..... 164/122.1; 164/162; 164/359
(58) Field of Search ..... 164/122.1, 125, 164/162, 359, 360

(56) References Cited

U.S. PATENT DOCUMENTS 3,273,211 A * 9/1966 Miraldi ..... 164/24
5,238,216 A * 8/1993 Pawlik ..... 249/56

* cited by examiner

*Primary Examiner*—Kuang Y. Lin
(74) *Attorney, Agent, or Firm*—Edward J. Brosius

(57) ABSTRACT

A method of casting an object, usually a railroad wheel, is provided. A graphite mold having a drag section and a cope section requires a plurality of riser openings in the cope section to ensure proper dimensional accuracy of the cast railroad wheel by allowing molten metal to continue to feed downwardly through the riser openings to the cast wheel cavity during initial cooling. The riser openings are lined with an improved insulating material in an accurate manner such that the insulating material is added between a machined riser opening in the graphite cope mold section and a mandrel inserted in the riser opening.

12 Claims, 4 Drawing Sheets

METHOD FOR CASTING OBJECTS WITH AN IMPROVED RISER ARRANGEMENT

BACKGROUND OF THE INVENTION

The present invention relates to a method for casting objects, and more particularly, a method for casting railroad wheels using an improved riser arrangement.

The preferred method for manufacturing cast steel railroad wheels is a bottom pressure casting foundry operation wherein molten steel under pressure is forced upwardly into a machined graphite mold. The mold is thereby filled with molten steel from the bottom upwardly. This bottom pressure casting operation eliminates many of the concerns associated with traditional top pouring of molten steel into molds in foundry operations such as splashing and insufficient filling.

In the bottom pressure casting of railroad wheels, upon separation of the top half or cope of the mold from the bottom half or drag of the mold, it is usual for the top facing front side of the wheel to have, depending on the diameter size of the wheel, from 6 to 14 raised sections or risers extending upwardly from the plate portion of the wheel. These risers extending upwardly from the plate of the wheel near the rim are designed to hold additional metal deemed necessary to fill downwardly into the mold during the cooling and solidification of the wheel just after pouring. There are accepted standards for porosity of steel railroad wheels that must be met by designing an adequate number of risers and, accordingly, an adequate volume of metal left to fill downwardly into the molds during cooling and solidification of the wheel.

In a machined graphite mold, the graphite absorbs heat from the molten steel in a manner such that the molten wheel is fairly rapidly cooled and solidified at the outer surface in contact with the graphite. This allows a high production rate of wheels as the cope and drag can be fairly quickly separated from each other shortly after pouring thereby allowing the wheel to be properly cooled and otherwise heat treated during its manufacture. Due to the rapid absorption of heat from the molten steel by the graphite mold, it is current practice to line the risers that are machined in the cope section of the mold with a phenolic resin sand mixture. This mixture is premixed using a batch mixing operation that requires the sand to be heated to dissolve the resin. Such resin sand mixture is poured into the risers such that each riser is filled. The cope section of the mold has been preheated, and a curing heating pad is utilized to provide heating of the resin sand filling the risers of the cope. The heat cures a layer of sand such that each riser is coated with a liner of sand. This riser lining operation may be repeated if necessary. The excess sand is then poured out leaving a hollow riser with a sprue opening in the bottom at the wheel interface.

In current riser practice utilizing silica sand and heat setting phenolic resins, the liner of each riser leaves a layer of sand of a thickness of about 0.375 inches. The remaining diameter of each lined riser opening is about 4.250 inches, with an average height of about 7.5 inches. However, it is difficult to accurately control the riser sand layer thickness, and accordingly, to have every mold with the same total riser volume. For a typical 36 inch diameter wheel with 13 risers, the volume of metal in all risers is equal to about 32.5 percent of the weight of a finished wheel. Such volume of metal is necessary in order to have dimensional accuracy and porosity in the finished cast wheel at or below an industry standard, given the insulating properties of the resin sand lined risers and the need for the steel in such risers to remain molten for a period of time. Further, due to the amount of sand needed to line each riser, each riser has about 2.0 pounds of sand.

Such an existing method of lining risers and bottom pressure casting railroad wheels in machined graphite molds requires a volume of sand that, for a 36 inch diameter with 13 risers, equals about 130 pounds to initially fill all risers. It is desirable to decrease the amount of such sand by utilizing improved insulating material as riser liners that will allow less molten steel in each riser, but allow such molten steel to remain molten long enough to achieve desired dimensional accuracy and porosity of the cast steel wheel.

It is also desirable to eliminate the use of a resin coated sand to eliminate sand handling and resin mixing operations.

It is also desirable to reduce the amount of time needed to line the riser openings. Such lining process using the phenolic resin coated sand as described above, including heating and relining, takes about 3 minutes for each cope.

SUMMARY OF THE INVENTION

Accordingly, it is an object of the present invention to provide a method for casting railroad wheels utilizing an improved riser arrangement.

It is another object of the present invention to provide an improved method for casting railroad wheels utilizing a bottom pressure casting operation with machined graphite molds wherein each riser is lined with an improved insulating material.

The graphite mold used in the bottom pressure casting of a steel railroad wheel is comprised of a top section or cope and a bottom section or drag. When assembled, the cope and drag provide a mold ready to accept molten steel through an in gate located at the bottom center of the drag. The top of the cope section includes a plurality of risers, typically between 6 and 14 depending on the size of the railroad wheel, which can range from 28 inches to 42 inches in diameter.

In lining the risers in accordance with the present invention, typically the cope section is inverted such that the open top of each riser faces downwardly. It should be understood, however, that the invention could be practiced with the cope oriented with the open top of each riser facing upwardly. Each riser is most usually a machined cylindrical opening. A mandrel is inserted downwardly into each riser, or alternatively a plate with multiple mandrels corresponding to each riser in the cope section is inserted such that one mandrel enters each upwardly facing open bottom of each riser.

Further, the mandrel itself comprises a cylindrical device having an outer surface smaller than the diameter of each riser opening. A cylindrical space of an exact desired thickness is formed between the outer surface of each mandrel and the inner surface or wall of each machined riser opening.

An inlet sleeve is presented at the upwardly facing bottom of each riser opening. Each inlet sleeve could be an individual inlet sleeve or a plurality of inlet sleeves held on a blow plate assembly such that the number of inlet sleeves corresponds to the number of riser openings in the cope section.

An insulating material of specially selected properties, typically with an insulation value about four times greater than silica sand, is then injected downwardly through the inlet into the cylindrical space between each mandrel and riser opening. One such choice of insulating material is Exactherm STL 210 and Exactherm G 220, coated with Exactcast I 101 and Exactcast II 202 resin, all available from Ashland Chemical Company. A layer of insulating material is also provided at the upwardly facing bottom of each riser opening to form a layer of insulating material on what will be the bottom of each riser opening. A smaller diameter sprue opening is formed in each such bottom liner.

Air is then exhausted in a reverse matter utilizing the inlet sleeve. A curing agent, usually in a form of a gas catalyst such as Isocure 700 from Ashland Chemical Company is then injected through each inlet such that the curing agent contacts the insulating material. The curing agent sets the insulating material to form an insulating layer of close dimensional accuracy to the exact desired thickness on the sides and bottom of each riser opening. Due to the exact thickness of each riser liner and the decreased diameter of each liner riser, the amount of insulating material needed to line is riser is reduced to about 1.4 pounds.

At the completion of the curing agent injection, it is desirable to extract the remaining curing agent, especially if it is in the form of a gas catalyst. The inlet sleeve would then be extracted and the mandrels would then be extracted. This would leave an insulating material lined riser opening of an accurate desired thickness to allow the molten steel to remain in a molten form for a period long enough to insure proper continued feeding through the riser. This would insure dimensional accuracy and proper porosity of the cast steel railroad wheel. It should be understood that the present invention could be practiced with the use of a curing agent pre-mixed with the insulating material, thus obviating the need for the curing agent injection.

DETAILED DESCRIPTION OF THE PREFERRED EMBODIMENT

Figure 1:
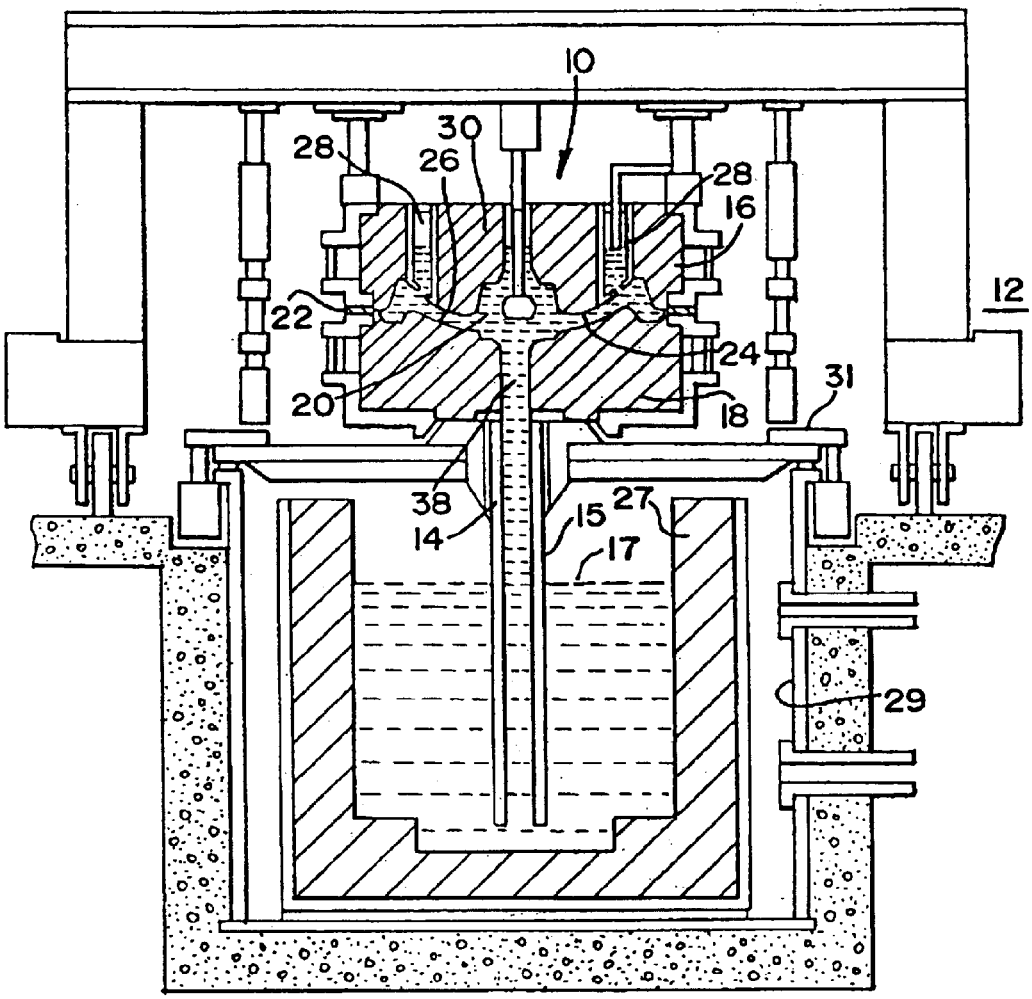
FIG. 1 is an elevational, cross sectional view of a bottom pressure casting arrangement utilizing a graphite mold with cope and drag sections.

Referring now to FIG. 1, pouring apparatus 12 is shown as designed for the bottom pressure casting of a railroad wheel. Graphite mold 10 is comprised of upper section or cope 16 and lower section or drag 18. The outline of a railroad wheel is formed as mold cavity 20 which is machined into the bottom of cope 16 and the top of drag 18. Riser openings 28 extend from lower face 24 to top surface 30 of cope 16. Depending on the size of the railroad wheel being cast, which varies from 28 inches in diameter to 42 inches in diameter, the number of risers can vary from 6 to 14.

Molten steel 17 is held in pouring ladle 27, which itself is received in a pouring ladle holding station 29. It is seen that roof assembly 31 acts to seal pouring ladle holding station 29 to allow the pressurization of such station. Ceramic pouring tube 16 extends downwardly into the reservoir of molten steel 17, allowing the upward passage of molten steel through in gate 14 through drag 18 to mold cavity 20.

Riser openings 28 are seen to be filled to near the top surface 30 of cope 16 with molten steel. The number and design of riser openings 28 is critical to the casting of the railroad wheel in mold cavity 20 to insure proper dimensional accuracy and porosity.

Drag 18 includes upper face 26, which is machined to form the inner surface of the railroad wheel being cast in mold cavity 20. Drag cavity face 26 is machined to form a relatively smooth railroad wheel surface, and provide minimal opportunities for voids on the inner surface of the railroad wheel being cast.

Figure 2:
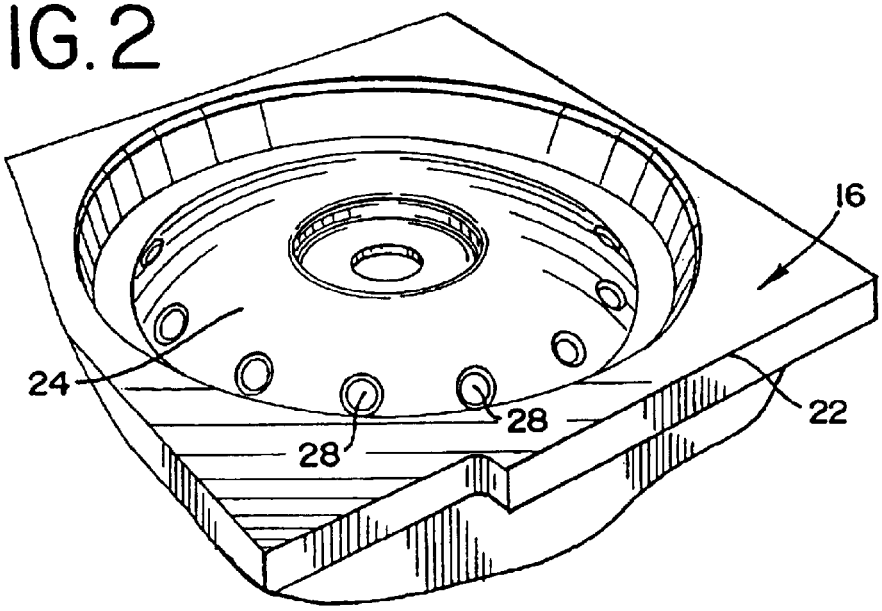
FIG. 2 is a perspective view of a cope section of a graphite mold showing the machined riser opening.

Referring now to FIG. 2, cope 16 is shown with parting line 22 which is the interface between cope 16 and drag 18. Further, as the view of cope 16 in FIG. 2 shows cope 16 inverted, lower face 24, which is machined to form the outer surface of the railroad wheel being cast in mold cavity 20, is now facing upwardly. Accordingly, riser openings 28 seem to extend downwardly in the view of FIG. 2. Such riser openings 28 extend through cope 16 to its upper surface 30.

Riser openings 28 are utilized both to vent mold cavity 20 during the bottom pressure injection of molten steel into mold cavity 20 and to provide reservoirs of molten steel to minimize shrinkage of the casting during cooling. Further, such reservoir of molten steel are designed to keep porosity of the railroad wheel being cast in mold cavity 20 to acceptable limits by allowing molten steel to continue to feed into mold cavity 20 during initial cooling of the molten steel therein.

Figure 3:
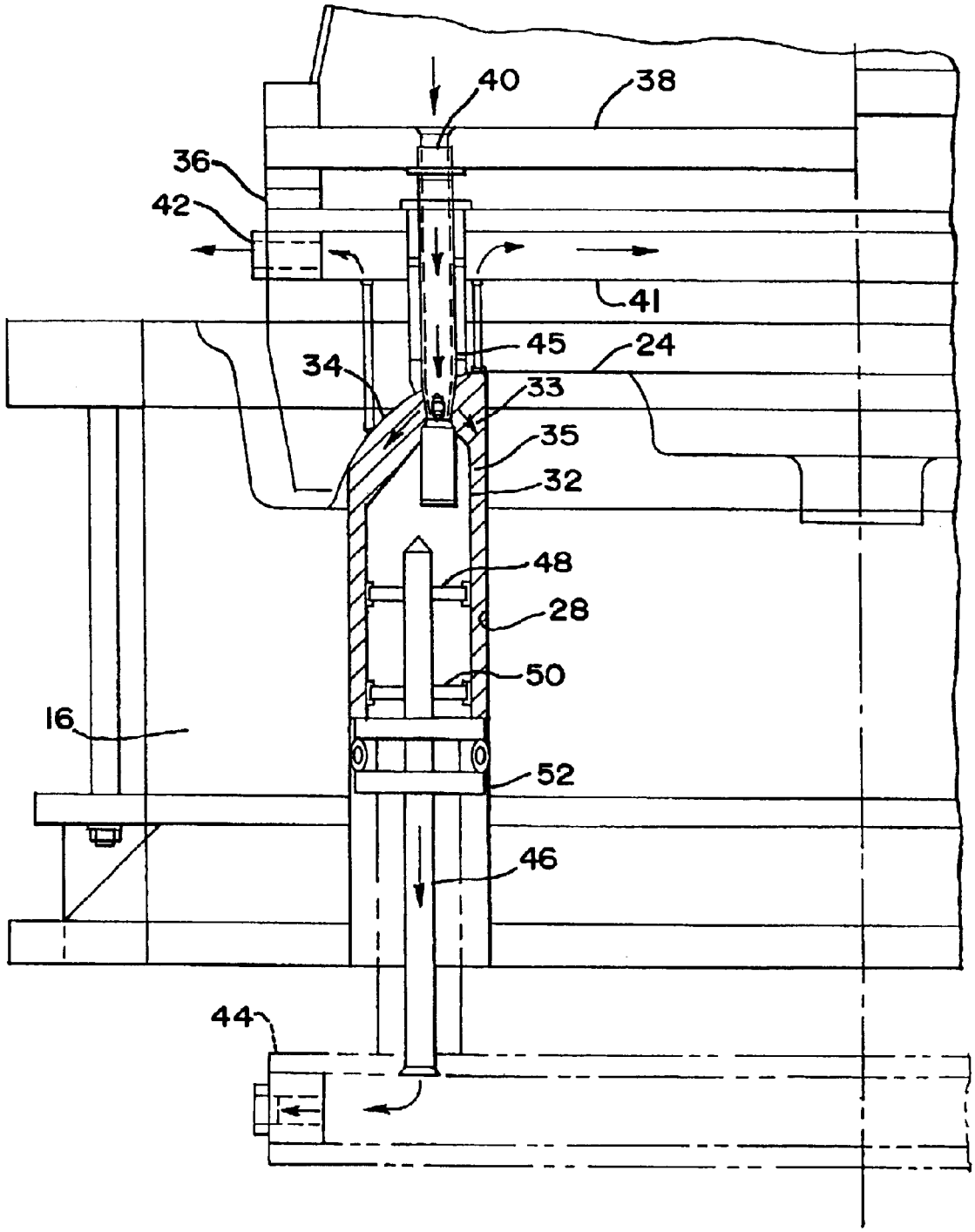
FIG. 3 is an elevational view in partial cross section of the insertion of an insulating material into a riser opening having a mandrel assembly.

Referring now to FIG. 3, graphite mold cope section is shown at 16, which includes a cylindrical riser opening 28. Cope section 16 has been inverted such that the bottom of riser opening 28 is facing upwardly. A mandrel liner 32 is shown as extending downwardly into riser opening 28. Mandrel liner 32 is generally cylindrical in shape having diameter less than riser opening 28 to form an accurate space between riser 28 and mandrel liner 32. Mandrel liner 32 also includes a top section 33 which is of a contour generally corresponding to the cope lower face 24 at riser opening 28. Such mandrel liner top section 33 forms a spacing between cope lower face 24 and mandrel liner top section 33 to allow an accurate dimensional layer of insulating material 35 to be placed therein.

Mandrel support structure 36 is seen to comprise blow plate 38 which is generally a rectangular or circular plate like structure extending above all riser openings 28 in cope section 16. Mandrel blow plate 38 includes insulating material inlet 40 positioned above each riser opening 28. Mandrel support structure 36 also includes a vent exhaust support plate 41 which itself includes exhaust vent 42 which extends downwardly to the cope lower face 24 at the upwardly facing portion of mandrel liner 33.

Mandrel support plate 44 is shown as a generally a rectangular or circular plate like structure positioned below cope section 16. Mandrel support plate 44 includes mandrel support rod 46 extending upwardly into riser opening 28 entering from the downwardly facing top of riser opening 28. Mandrel support rod 46 is seen to be a generally cylindrical elongated structure, having support arms 48 and 50 extending radially to engage mandrel liner 32 extending into riser opening 28. Such mandrel support plate 44 and associated components are utilized to accurately position and hold mandrel liner 32 in riser opening 28 to cause an accurate spacing to be formed between mandrel liner 32 and riser opening 28 to allow insulating material 35 to be filled therein. Another component of mandrel support plate 44 is mandrel support riser seal 52 which is seen to be generally a plate like structure that seals the downwardly facing top of each riser opening 28.

In operation, mandrel support structure 36 would be placed above cope section 16. Mandrel liner 32 would be extended downwardly into the upwardly facing bottom of riser opening 28. Mandrel contour plate 34 would be positioned above each riser opening 28 to form the desired contour with cope lower face 24. Insulating material delivery tube 45 is seen to be positioned between sand inlet 40 and mandrel contour plate 34 to extend inwardly of mandrel liner top section 33. Mandrel support plate 44 is positioned below cope section 16 such that mandrel support rod 46 and mandrel support arms 48 and 50 are allowed to contact mandrel liner 32 to precisely position mandrel liner 32 within riser opening 28. Mandrel support plate sealing structure 52 seals the downwardly facing top of each riser opening 28.

At this time, insulating material is injected usually under air pressure into each riser opening space between riser opening 28 and mandrel liner 32 to form a layer of insulating material 35 both between riser opening 28 and the sides of mandrel liner 32 and the top section 33 of mandrel liner and mandrel contour plate 34.

Figure 4:
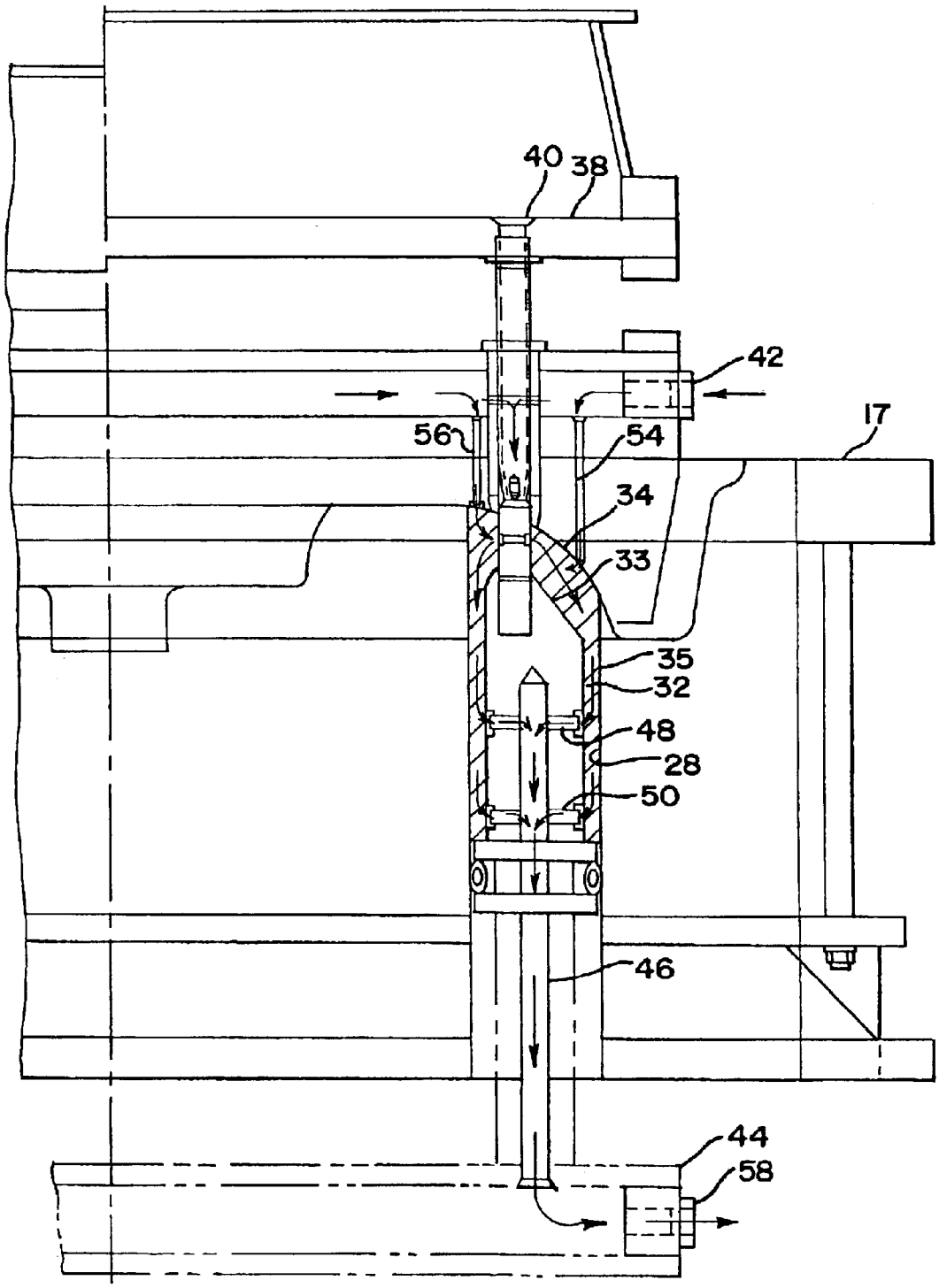
FIG. 4 is an elevational view in partial cross section of the injection of a curing agent to contact the insulating material lining the riser opening having a mandrel assembly.

Referring now to FIG. 4, the cure cycle of the insulating material is shown. Curing gas is inlet through what was exhaust vent 42 but is now utilized as gas inlet vent in exhaust plate 41. Gas inlets 54 and 56 are utilized through cope support structure 17 to have curing gas interact and act as a catalyst to cure insulating material 35. Gas is allowed to past through curing material 35 as gas outlet 58 communicates through the interior of mandrel support rod 46 to thereby allow an accurate and complete cure of insulating material 35.

As previously mentioned, one choice of insulating material is Exactherm STL 210 and Exactherm G 220 coated with Exactcast I 101 and Exactcast II 202 resin, all available from Ashland Chemical Company. Further, the curing agent gas catalyst can be Isocure 700 also available from Ashland Chemical Company.

It should be known that the typical cure process of gas catalyst interacting with the insulating material is accomplished in the neighborhood of a 4 second gas inlet process. However, it is necessary to remove the curing gas from the riser opening 28 in an exhausting process it takes in the neighborhood of 8 seconds. Accordingly, it is seen that the more dimensionally accurate riser lining of the present invention is accomplished in a total process time of 12 to perhaps 20 seconds, as opposed to the former heat curing resin sand operation which took in the neighborhood of 3 minutes.

Figure 5:
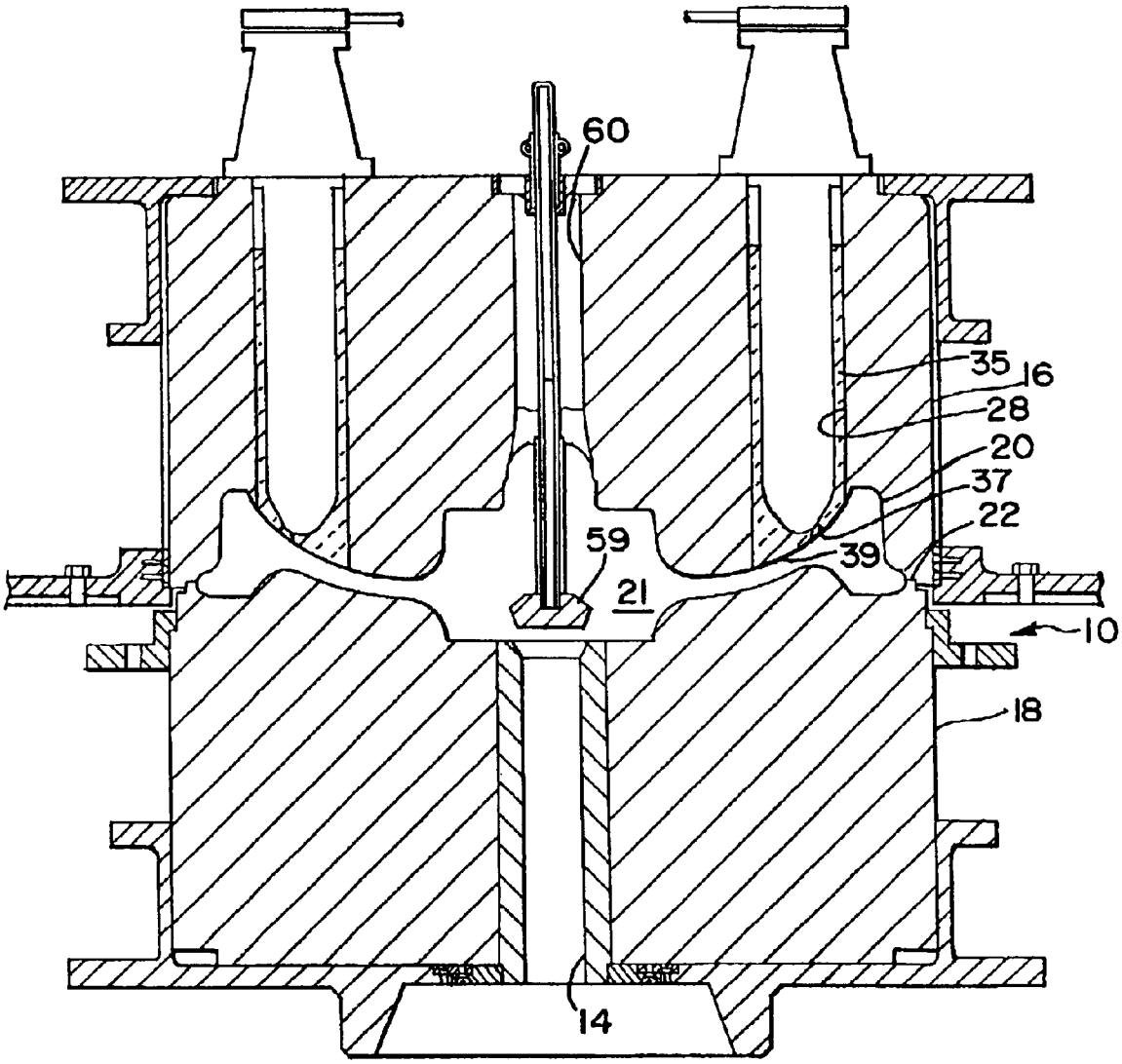
FIG. 5 is an elevational partial cross sectional view of the assembled graphite mold utilizing the lined riser ready for the bottom pressure insertion of molten steel to form a railroad wheel.

Referring now to FIG. 5, an assembled graphite mold 10 is shown as comprising upper cope section 16 and lower drag section 18 combined along party line 22. Mold cavity 20 is seen to be machined in the shape of a railroad wheel to be cast in a bottom pressure casting operation. Each riser opening 28 is seen to be accurately lined with insulating material 35 which extends along the sides of cylindrical riser opening 28 and the bottom of riser opening 28 in a contour 39 corresponding to what will be an outwardly facing section of railroad wheel 21 to be cast in mold cavity 20. Further, sprue opening 37 of a section through insulating material 35 has been formed to form a reduced area riser section allowing the riser metal to break at the sprue upon separation of the cope section 16 from the drag section 18 after pouring and initial solidification of the steel.

Steel is poured in an operation described above upwardly under pressure through ingate 14 utilizing a pouring tube such that molten steel extends upwardly and fills molt cavity 20 to form railroad wheel 21. A stopper assembly 59 is seen to extend downwardly through center opening 60 in cope section 16 such that, upon filling mold cavity 20 with molten steel extending upwardly through sprue 37 to fill each lined riser opening 28 to the desired level, the pouring pressure is suspended contemporaneously with the extension of stopper 59 into the top section of ingate 14 to seal the molten steel in mold cavity 20. Again as described above, after a certain period of time, usually 6–12 minutes, depending on wheel size, cope section 16 can be removed from drag section 18 after appropriate solidification of the molten metal in mold cavity 20.

It can be riser openings 28 are accurately formed to the predetermined spacing between mandrel liner 32 and riser opening 28 to provide the predetermined volume of molten metal to continue to pour downwardly into mold cavity 20 during solidification of railroad wheel 21. This ensures dimensional accuracy of railroad wheel 21 as well as proper porosity. Furthermore, along with the time efficacy in lining riser opening 28, it is also seen that the typical volume of molten steel needed in the machined accurately lined risers openings 28 is decreased by about 60% from that in the prior art method of heat cured sand lined riser openings. The cured insulating material in each riser opening is about 0.5 inches thick; the lined riser opening is of a diameter of about 4 inches.

What is claimed is:

1. A method of lining riser openings in a graphite mold comprising the steps of:

providing a graphite mold cope section having a plurality of riser openings, each of the riser openings having an inner surface, inverting the cope section such that a top of each riser opening faces downwardly, and that a bottom of each riser opening faces upwardly, inserting a mandrel into the upwardly facing bottom of each riser opening, the mandrel having an outer surface and each riser opening having an inner surface and sealing the downwardly facing top of each riser opening, placing a vented plate assembly adjacent the upwardly facing bottom of each riser opening in the cope section, injecting an insulating material through the vented plate assembly between the outer surface of the mandrel and the inner surface of each riser opening, and injecting a curing agent to contact the insulating material to form a layer of cured insulating material on the inner surface of each riser opening.

2. The method of claim 1 wherein the insulating material is injected through a blow tube, the mandrel interacts with the blow tube when the mandrel is inserted into the riser opening, and the insulating material surrounds the blow tube to form a sprue opening in the insulating material lining each riser opening.

3. The method of claim 1 further comprising the steps of forcing the insulating material between the mandrel and the riser openings with pressurized air, venting air from the riser openings after the insulting material is injected, and injecting the curing agent as a gas catalyst to contact the insulating material.

4. The method of claim 1 wherein the mandrel insertion depth can be adjusted such that the mandrel is held at a predetermined distance from the downwardly facing top of each riser opening.

5. A method of casting a railroad wheel comprising the steps of providing a graphite mold having a drag section and a cope section, providing a plurality of riser openings in the cope section, each riser having an inner surface, inverting the cope section such that a top of each riser opening faces downwardly and a bottom of each riser opening faces upwardly, inserting a mandrel into the upwardly facing bottom of the riser opening, the mandrel having an outer surface, the mandrel sealing the downwardly facing top of the riser opening, injecting an insulating material downwardly between the outer surface of the mandrel and the inner surface of the riser opening, wherein the insulating material is injected through a blow tube, the mandrel interacts with the blow tube when the mandrel is inserted into the riser opening, the mandrel is supported and positioned by contacting a mandrel support inserted into the downwardly facing top of the riser opening, and the insulating material surrounds the blow tube to form a sprue opening in the insulating material lining the riser opening, injecting a curing agent to contact the insulating material and cure the insulating material to form a layer of cured insulating material on the inner surfaces of the riser opening, assembling the cope section and drag section to form a completed graphite mold, and pouring molten steel into the completed graphite mold to cast a railroad wheel.

6. The method of claim 5 wherein each riser opening is of a generally cylindrical shape, and the mandrel is of a generally cylindrical shape generally smaller radially than the riser opening such that a generally hollow, generally cylindrical space is formed between the mandrel outer surface and the inner surface of the riser opening, the insulating material being formed on the inner surface of the riser opening to form a lined riser opening of a generally cylindrical shape and wherein the cured insulating material generally conforms to the space between the mandrel outer surface and the riser inner surface.

7. The method of claim 6 wherein the riser opening is of a diameter of about 5 inches, the cured insulting material is of a thickness of about 0.5 inches and the lined riser opening is of a diameter of about 4 inches.

8. The method of claim 6 wherein the lined riser opening is of a diameter of about 4 inches.

9. The method of claim 5 wherein the insulating material is a resin coated sand and the curing agent is a gas catalyst.

10. A method of lining riser openings in a graphite mold comprising the steps of:

providing a graphite mold cope section having a plurality of riser openings, each of the riser openings having an inner surface, inserting a mandrel into the upwardly facing bottom of each riser opening, the mandrel having an outer surface and each riser opening having an inner surface and sealing the downwardly facing top of each riser opening, placing a vented plate assembly adjacent the upwardly facing bottom of each riser opening in the cope section, injecting an insulating material through the vented plate assembly between the outer surface of the mandrel and the inner surface of each riser opening.

11. The method of claim 10 further comprising injecting a curing agent to contact the insulating material to form a layer of cured insulating material on the inner surface of each riser opening.

12. The method of claim 10 wherein the cope section is inverted prior to the insertion of the mandrel such that a top of each riser opening faces downwardly.

* * * * *